US005631660A

United States Patent [19]

Higashiguchi et al.

[11] Patent Number: 5,631,660

[45] Date of Patent: May 20, 1997

[54] ANTENNA MODULE FOR A PORTABLE RADIO EQUIPMENT WITH A GROUNDING CONDUCTOR

[75] Inventors: Yutaka Higashiguchi; Mitsuo Inagaki; Takeyasu Maeda, all of Kawasaki; Kazuyoshi Aoki, Tokyo; Kohichi Kamei, Tokyo; Toshiaki Amano, Tokyo, all of Japan

[73] Assignee: Fujitsu Limited, Kanagawa, Japan

[21] Appl. No.: 590,470

[22] Filed: Nov. 7, 1995

Related U.S. Application Data

[63] Continuation of Ser. No. 226,707, Apr. 12, 1994, abandoned.

[30] Foreign Application Priority Data

Aug. 6, 1993 [JP] Japan ..... 5-214880

[51] Int. Cl.[6] ..... H01Q 1/24

[52] U.S. Cl. ..... 343/702; 343/700 MS; 343/750; 343/846

[58] Field of Search ..... 343/700 MS, 702, 343/745, 750, 828, 861, 723, 724, 846, 848; H01Q 1/24

[56] References Cited

U.S. PATENT DOCUMENTS

| | | | |
|---|---|---|---|
| 4,907,006 | 3/1990 | Nihikawa et al. | 343/713 X |
| 5,231,407 | 7/1993 | McGirr et al. | 343/841 X |
| 5,268,702 | 12/1993 | Amano et al. | 343/702 X |

FOREIGN PATENT DOCUMENTS

| | | | |
|---|---|---|---|
| 0399524 | 11/1990 | European Pat. Off. | H01Q 21/06 |

*Primary Examiner*—Donald T. Hajec
*Assistant Examiner*—Tho Phan

[57] ABSTRACT

An antenna module capable of finely adjusting the resonant frequency and having an antenna element exclusively used for radio transmission and reception to provide a broad frequency band characteristic. This antenna module is composed of a dielectric substrate molded in a predetermined shape, a grounding conductor in the form of sheet provided on one surface of the dielectric substrate, and antenna element conductor in the form of sheet provided on the opposite surface to the above one surface and having end portion being almost V-shaped end folded, and an adjusting member inserted into the almost V-shaped folded end portion.

8 Claims, 13 Drawing Sheets

RELATIONSHIP OF GAP DIMENTION BETWEEN
ANTENNA ELEMENT CONDUCTOR - GROUNDING CONDUCTOR
WITH RESONANCE FREQUENCY

RELATION OF RESIN FILL
UNDER LOOP LOWER PORTION
WITH RESONANCE FREQUENCY

ANTENNA MODULE FOR A PORTABLE RADIO EQUIPMENT WITH A GROUNDING CONDUCTOR

This is a continuation of application Ser. No. 08/226,707, filed Apr. 12, 1994, now abandoned.

BACKGROUND OF THE INVENTION

1. Field of the Invention

The present invention relates to a small-sized antenna module, and particularly to an antenna module incorporated into portable radio equipment.

In radio equipment, an antenna is indispensable for the transmission and reception of radio wave. Particularly in small portable radio equipment, it is necessary to have a small-sized antenna with a high sensitivity built in the body of the equipment.

2. Related Prior Art

As a small antenna, an inverted F-type antenna and an S-type antenna have been peviously known. The summarized structure and the function of such antennas are disclosed, e. g. in FIGS. 1 and 2 of the prior U.S. patent application Ser. No. 858,209, filed in the Patent Office on 26, Mar., 1992 by some of the present applicants.

Those conventional inverted F-type antenna and S-type antenna are, as described in the above U.S. patent application, produced by working a conductive plate with difficulties in obtaining a desirable characteristic in respect of miniaturization and dimensional accuracy.

The applicants have thus proposed a structure and a process of producing an antenna module formed by a dielectric substrate such as a resin block in the above U.S. patent application.

The structure of the previously proposed antenna module is illustrated in FIG. 18.

In FIG. 18, (A) is a perspective view of such an antenna module wherein a dielectric substrate 1 is formed of e.g. as a thermosetting epoxy resin, thermoplastic polyether sulfone, or polyester, etc. used for an semiconductor IC mold.

A grounding conductor 2 is formed on a bottom face of the dielectric substrate 1.

An antenna element conductor 3 has a closed loop portion 31 folded at the end thereof. This type of antenna with the closed loop portion 31 is called a P-type antenna and has a leading portion 35 which also has a grounding line 36 and a feeder 37 electrically connected to the antenna element conductor 3, respectively. The space between the conducting line 36 and the feeder 37 determines the input impedance of the antenna.

In FIG. 18, (B) is a cross sectional view cut along the line A–A' in (A) of FIG. 18. As illustrated, the dielectric substrate 1 is box-shaped with a vacant space 6. A resonance frequency $f_c$ is varied depending on a size of the vacant space 6 as will be described hereinafter.

In FIG. 18, (C) shows a part of a cross sectional view of the grounding conductor 2, the antenna element conductor 3, and the leading portion 35, in which a substrate 20 of a flexible printed-circuit (FPC) is formed of a plastic film, e.g. polyimide film. On the plastic film 20, a metallic leaf such as a cupper leaf 21 is applied.

For one example, the plastic film 20 which is a substrate of FPC may be a polyimide film with a thickness of 50 μm and the cupper leaf 21 with a thickness of 35 μm. The size of the antenna module in FIG. 18 has a height of about 11 mm, a width of 15 mm and a length of 30–35 mm, and has a resonant frequency $f_c$ in the frequency band 800–900 MHz.

In the electric equivalent circuit of the previously proposed antenna module, the antenna element conductor portion forms an inductance L, and the space between the antenna element conductor 3 and the grounding conductor 2 corresponds to a capacitance C connected in parallel with the inductance L.

Therefore, the inductance L of the resonant frequency of the antenna module is determined by the longitudinal and lateral dimensions of the antenna element conductor 3 while the capacitance C is determined by the space between the antenna element conductor 3 and the grounding conductor 2, so that changing the area of the antenna element conductor 3 or the space between the antenna element conductor 3 and the grounding conductor 2 would change the resonant frequency $f_c$.

In the arrangement of the previously proposed antenna module thus described, some adjustment in respect to an accuracy of μm unit is required after the formation of the antenna module for a sufficient characteristic. The accuracy in forming the dielectric substrate 1 is important for its antenna module in the entirety, resulting in the increase of producing cost.

On the other hand, current flowing in a high frequency antenna as shown in FIG. 18 which is operated in the inverted F type antenna mode is concentrated in the peripheral portion of the antenna element conductor 3. This is considered in principle as phenomena due to a skin effect of the high frequency current.

In the previously proposed antenna module of FIG. 18, there is a dielectric resin provided at the side walls of the antenna element so that particularly the equivalent dielectric constant, as one of the antenna characteristics becomes high. As a result, the realization of a broad frequency band for the antenna element is prevented.

Furthermore, the above described antenna module forms a single unit used only for the transmission or reception of radio wave. It is difficult to obtain a desirable frequency band for both, radio transmisson and reception.

SUMMARY OF THE INVENTION

Accordingly, it is an object of the present invention to provide an antenna module having a structure adjustable in a resonant frequency $f_c$, a structure for a broad frequency band characteristic, and a structure exclusively used as an antenna element for radio transmission or reception.

It is a further object of the present invention to provide an antenna module having a structure such that the length of an antenna element conductor can be changed or the gap between an end portion of the antenna element conductor and a grounding conductor is adjustable, thereby adjusting the resonance frequency of the antenna.

It is a still further object of the present invention to provide an antenna which can avoid the concentration of a current flowing in the peripheral portion of an antenna element conductor that largely affects the frequency band width.

It is a further object of the present invention to provide a composite antenna module in which two separate antenna element conductors are formed in a common dielectric substrate.

An antenna module according to the present invention basically comprises a dielectric substrate molded in a predetermined shape; a grounding conductor in the form of sheet provided on one surface of the dielectric substrate; an antenna element conductor in the form of sheet provided on the opposite surface to the one surface of the dielectric substrate and having an end portion being almost V-shaped and folded; and an adjusting member inserted into the almost V-shaped folded end portion.

According to another aspect of the present invention, an antenna module may comprise a dielectric substrate molded in a predetermined shape; a grounding conductor in the form of a sheet provided on one surface of the dielectric substrate; an antenna element conductor provided on the opposite surface to the one surface of the dielectric substrate and having an end portion being alomost V-shaped and folded; a gap provided between the almost V-shaped folded end portion and the grounding conductor in the form of a sheet in the dielectric substrate; and, an adjusting member inserted into the gap to adjust the size of the gap.

According to further aspect of the present invention, an antenna module may comprise a dielectric substrate molded in a predetermined shape; a grounding conductor in the form of a sheet provided on one surface of the dielectric substrate; and an antenna element conductor in the form of a sheet provided on the opposite surface to the one surface of the dielectric substrate; the dielectric substrate having a convex portion on both side faces perpendicular to the grounding conductor in the form of a sheet and the an antenna element conductor in the form of a sheet.

According to a further aspect of the present invention, an antenna module may comprise a dielectric block formed of a first dielectric substrate and a second dielectric substrate disposed on both side faces of the first dielectric substrate and having a dielectric constant different from that of the first dielectric substrate; a grounding conductor in the form of a sheet provided on one surface perpendicular to a face on which the second dielectric substrate of the dielectric block is disposed; and an antenna element conductor in the form of sheet provided on the opposite face to the one surface of the dielectric block.

An antenna module having a transmitting or receiving antenna according to the present invention may comprise a dielectric substrate molded in a predetermimed shape having a first and second portions as a unit; a common grounding conductor in the form of a sheet provided on one surface of the dielectric substrate; a first antenna element conductor in the form of a sheet provided on the opposite surface to the one surface of the first portion of the dielectric substrate; and a second antenna element conductor in the form of sheet provided on the opposite surface to the one surface of the second portion of the dielectric substrate; the resonant frequency of the the first antenna element conductor being different from that of the second antenna element conductor.

Other objects and advantages of the present invention will become apparent from the detailed description to follow taken in conjunction with the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DESCRIPTION OF THE PREFERRED EMBODIMENTS

Figure 1:
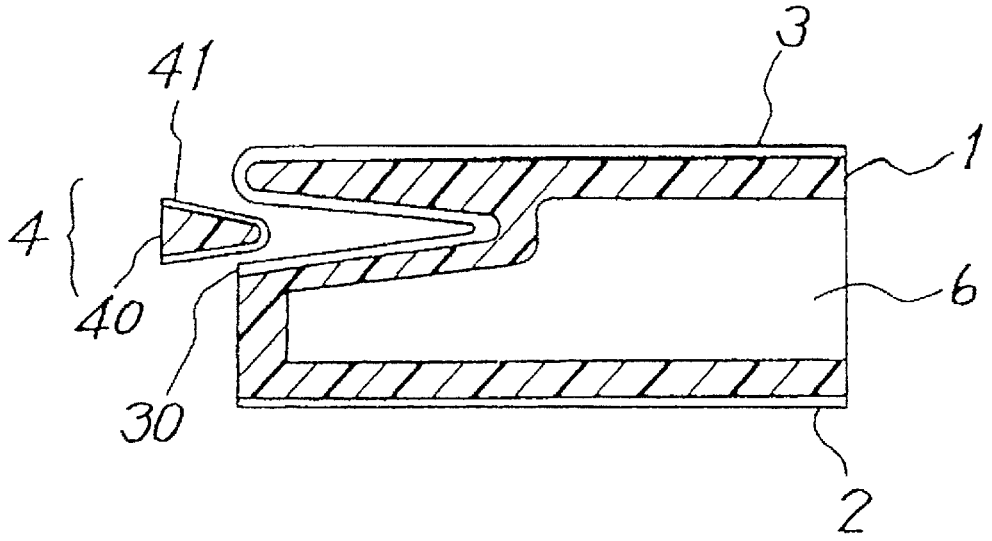
FIG. 1 is a cross sectional view of a first embodiment of the present invention.

Throughout the following descriptions of embodiments of the present invention, identical reference numerals or symbols are used to designate identical or similar portions.

FIG. 1 shows a first embodiment of an antenna module of the present invention which can adjust the dimensions with an accuracy of μm unit for providing sufficient characteristics.

Figure 18A:
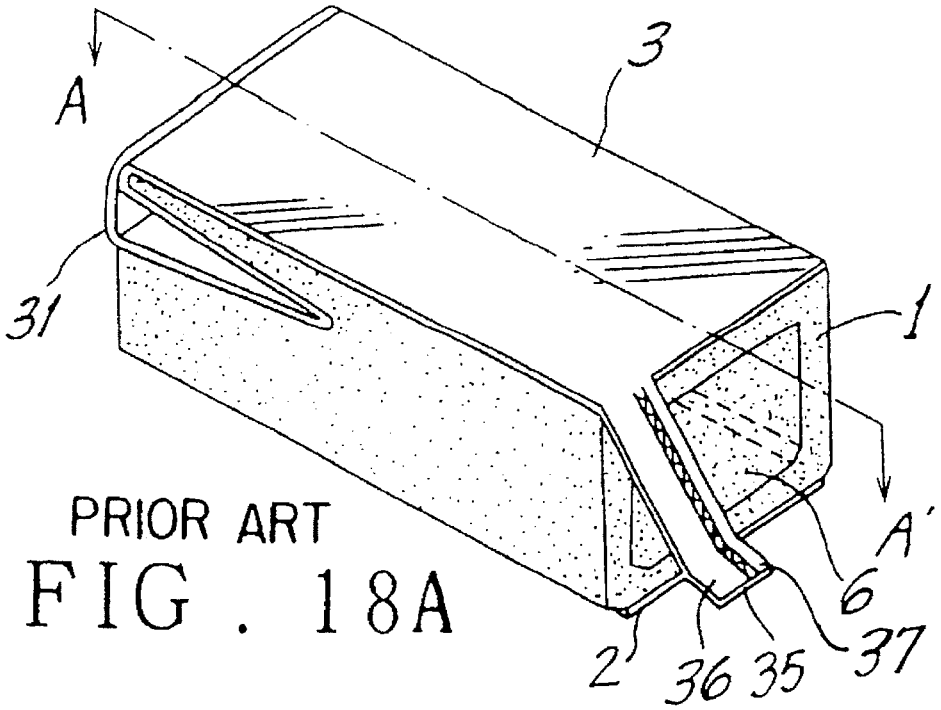
PRIOR ART FIG. 18A
FIGS. 18A–18C are a perspective view and section views showing a structure of a conventional antenna module.
Figure 18B:
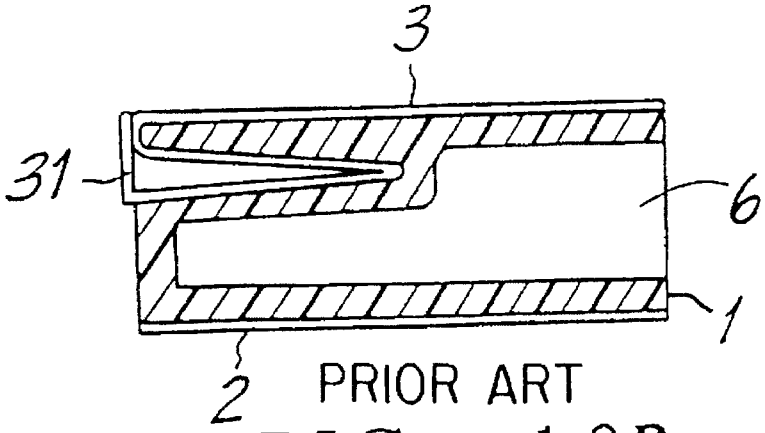
PRIOR ART FIG. 18B
Figure 18C:
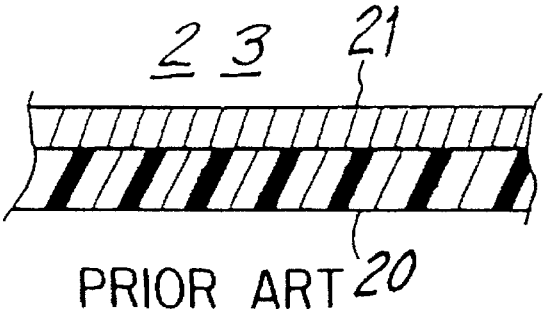
PRIOR ART FIG. 18C

FIG. 1 shows the cross sectional view of a first embodiment of the antenna module according to the present invention in the same manner as the cross sectional view of the structure of the conventional antenna module shown in (B) of FIG. 18, as described above.

In FIG. 1, an dielectric substrate 1 is formed of a epoxy resin or the like as in the antenna module shown in FIG. 18.

A grounding conductor 2 and an antenna element conductor 3 are formed of a flexible printed-circuit in which a cupper leaf is applied on a plastic film in the same manner as in the example described with reference to FIG. 18.

Namely, a flexible printed-circuit is entirely applied on a bottom face of the dielectric substrate 1 to form the grounding conductor 2. On the upper face of the dielectric substrate 1, a flexible printed-circuit is applied to Form the antenna element conductor B. The leading end of the antenna element conductor 3 has an almost V-shaped folded portion 30 as shown.

The characteristic portion of the present invention resides in an arrangement such that an adjusting member 4 as a post-attaching component is inserted into the almost V-shaped folded portion 30.

In the embodiment of FIG. 1, the adjusting member 4 as a post-attaching component is composed of a dielectric portion 40 of a wedge shape of the same material as the dielectric substrate 1 and a looped conductor 41 formed on the surface of the dielectric portion 40. The conductor 41 may be made of a sheet-shaped conductor of a flexible printed-circuit like the antenna element conductor 3 and the grounding conductor 2.

The adjusting member 4 is inserted into the almost V-shaped folded end 30 of the antenna element conductor 3. Therefore, both ends of the V-shaped folded end portion 30 are electrically shorted by the conductor 41 of the adjusting member 4.

This forms a loop at the leading end of the antenna element conductor 3 like the conventional one to form a P-type antenna. At the same time, adjusting the degree of the insertion of the adjusting member 4 enables the length of the loop of the P-antenna to be finely adjusted whereby the length of the antenna element conductor 3 is effectively adjustable.

As previously described with reference to FIG. 18, the length of the antenna element conductor 3 is one of the factors to determine the resonance frequency $f_c$ of the antenna module. Therefore, fine adjustment of a degree by which the adjusting member 4 is inserted into the V-shaped folded end portion 30 may vary the length of the antenna element conductor 3 so that the resonance frequency $f_c$ can be finely adjusted.

Also in the embodiment shown in FIG. 1 as described with reference to FIG. 18, the dielectric substrate 1 may be provided with a vacant space 6 to determine the resonant frequency $f_c$. if necessary.

For the process of producing the antenna module shown in FIG. 1, the process disclosed in the U.S. patent application Ser. No. 858,209 filed by these applicants as described above may be adopted without any modification.

Figure 2:
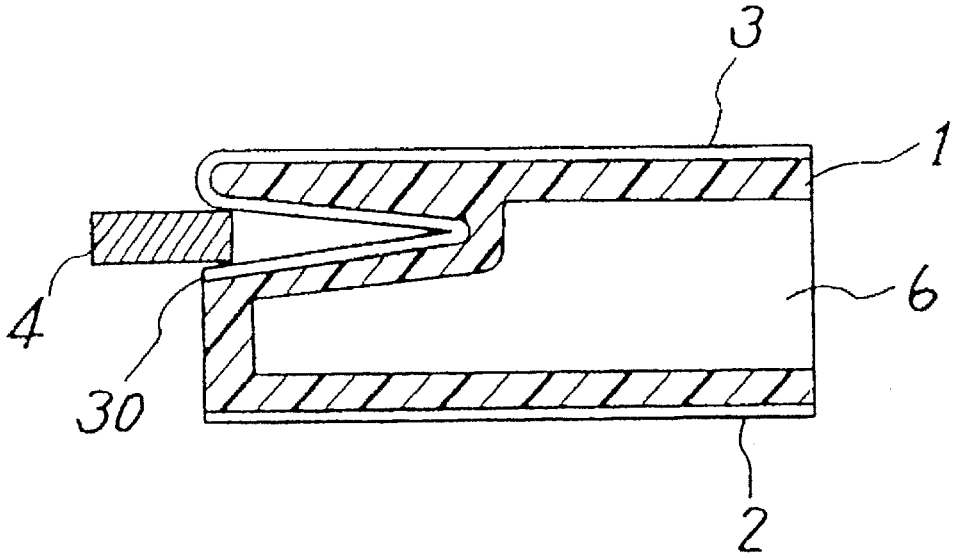
FIG. 2 is a cross sectional view of a second embodiment of the present invention.

FIG. 2 shows a cross-sectional view of second embodiment of the present invention.

The difference between this embodiment and the first embodiment of FIG. 1 is that in the second embodiment, the adjusting member 4 as a post-attaching component to the leading end of the antenna element formig portion is formed by a metallic plate 4 for simplification.

Namely, as shown in FIG. 2, changing the position in which the metallic plate 4 as an adjuting member is inserted into the almost V-shaped folded portion 30 formed at the leading end of the antenna element conductor 3 may also modify the loop length for a simpler fine adjustment of the resonance frequency.

The other elements are the same as in the first embodiment shown in FIG. 1.

Figure 3:
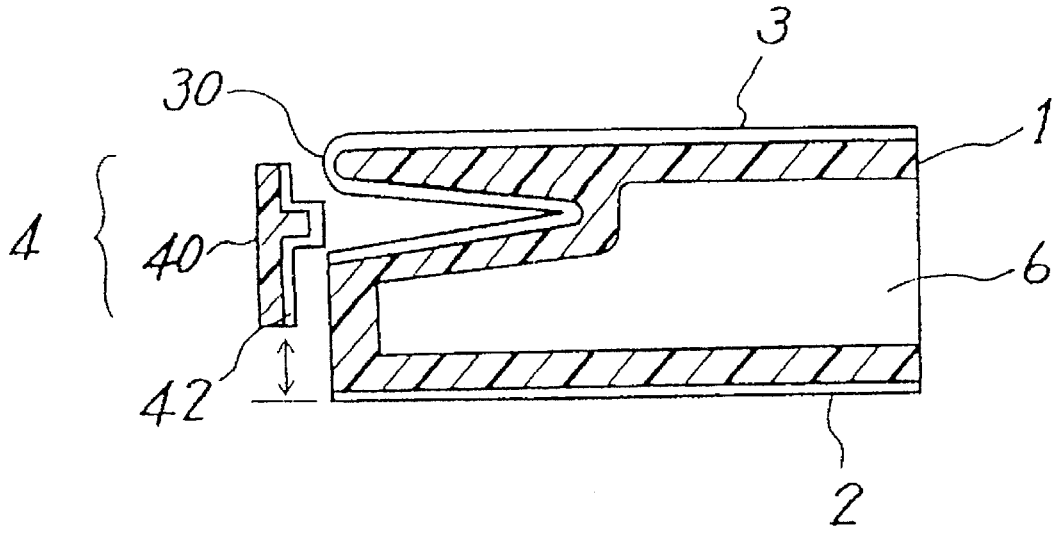
FIG. 3 is a cross sectional view of a third embodiment of the present invention.

FIG. 3 shows a cross sectional view of a third embodiment of the antenna module according to the present invention. Also in this embodiment, the dielectric substrate 1, the grounding conductor 2, and the antenna element conductor 3, and the vacant space 6 provided in the dielectric substrate 1 if necessary are the same as those described in connection with FIGS. 1 and 2.

The charactaristic portion of the third embodiment in FIG. 3 resides in an arrangement of the adjusting member 4.

Namely, the adjusting member 4 as a post-attaching component for the leading end of the antenna element forming portion is formed of a T-shaped dielectric portion 40 and a conductor 42 provided on the side of the dielectric portion 40 facing the V-shaped portion 30. By the comparison with the first embodiment on FIG. 1, the third embodiment of FIG. 3 is characterized in that the dielectric portion 40 and the conductor 42 provided on the side of portion 40 of the adjusting member 4 longitudinally extend along the antenna module.

Namely, of the adjusting member 4 in the third embodiment in FIG. 3, a part of a T-shaped conductor portion 42 is formed of a protrusion shape and inserted into the V-shaped folded portion 30 provided at the leading end of the antenna element conductor 3.

The insertion of the adjusting member 4 into the V-shaped end portion 30 makes an electrical connection across the end portion 30 through the conductor portion 42 whereby the antenna element conductor 3 as described above forms a P-type antenna element. At the same time, an equivalent gap between the antenna element conductor 3 and the grounding conductor 2 is defined by the conductor portion 42.

As described above with the reference to a determining factor of the resonance frequency of the antenna module, the gap between the antenna element conductor 3 and the grounding conductor 2 determines an equivalent parallel capacity so that changing the gap can change the resonance frequency $f_c$.

Therefore, by preparing many components with a variety of lengths of the adjusting member 4, many similar types of antenna modules can be produced with different characteristics by using the same metal mold.

Figure 4:
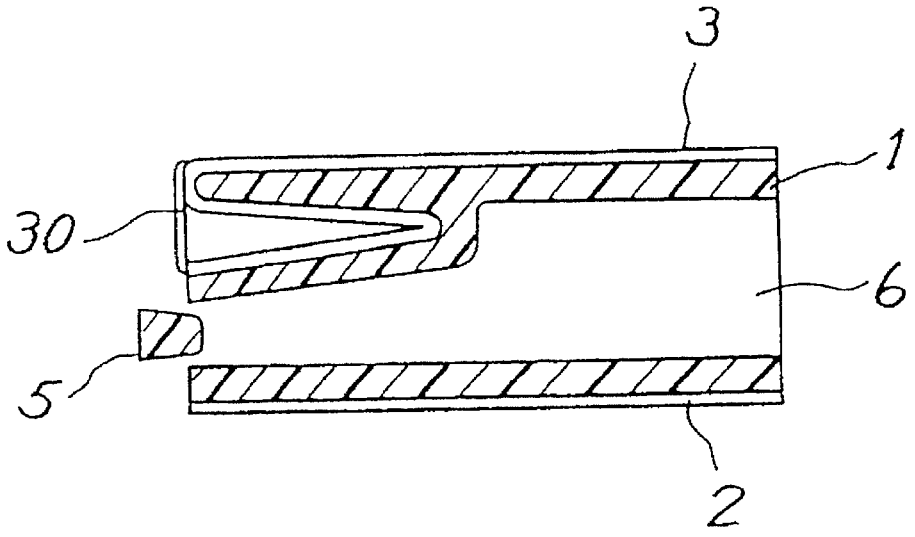
FIG. 4 is a cross sectional view of a fourth embodiment of the present invention.

FIG. 4 shows a cross sectional view of the antenna module according to a fourth embodiment of the present invention.

In the same manner as the first to third embodiments aforementioned, the fourth embodiment shown in FIG. 4 comprises the dielectric substrate 1, the grounding conductor 2, the antenna element conductor 3, and the almost V-shaped end portion 30 provided at the leading end thereof.

The specific feature of the fourth embodiment is that the vacant space 6 is penetrated into the dielectric substrate 1. The insertion of a dielectric block 5 by forming a wedge component of a material identical to or different from the dielectric substrate 1, into the penetrated portion of space 6 can adjust the resonance frequency $f_c$.

Namely, when the dielectric block 5 formed of the same material as the dielectric substrate 1 is inserted into the penetrated portion of the vacant space 6, the gap dimension between the looped portion 30 at the leading end of the antenna element conductor 3 and the grounding conductor 2 is adjustable.

If the dielectric block 5 is prepared as a wedge structural component of a material different in dielectric constant from the dielectric substrate 1, the dielectric constant of the gap is adjustable.

Such an arrangement can adjust an equivalent capacity of the antenna module so that the resonance frequency $f_c$ can be adjusted.

As described above, in the first to fourth embodiments shown in FIGS. 1 to 4, the length of the antenna element conductor 3 can be changed or the gap between the end portion 20 of the antenna element conductor 3 and the grounding conductor 2 can be adjusted, thereby adjust the resonant frequency $f_c$.

Figure 5:
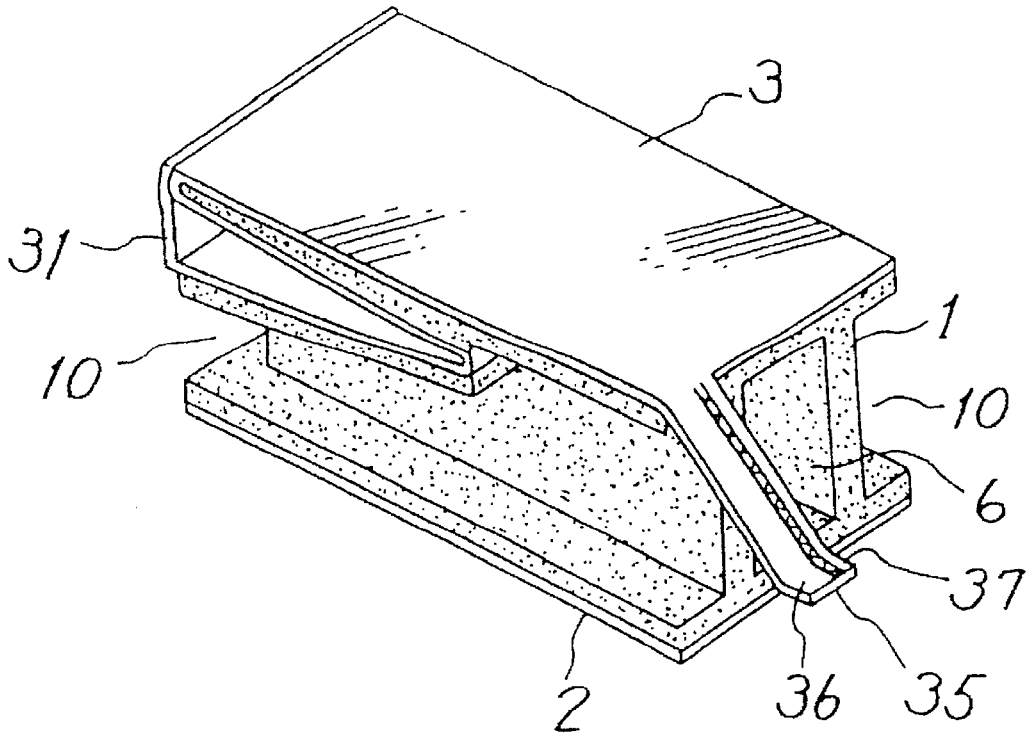
FIG. 5 is a perspective view of a fifth embodiment of the present invention.

FIG. 5 shows a perspective view of the antenna module of a fifth embodiment of the present invention.

The fifth embodiment of FIG. 5 has a structure in which each side face of the resin substrate of the antenna is recessed to form at each side a recess portion 10 by using the technique of a conventional resin unit type antenna. This reduces the equivalent dielectric constant of the peripheral portion of the antenna element.

Namely, according to the principle of this embodiment, recessing inwardly of the resin at each side face of the antenna can reduce the equivalent dielectric constant of the antenna element peripheral portion in which concentrated current flowing largely affects the frequency band width.

Figure 6:
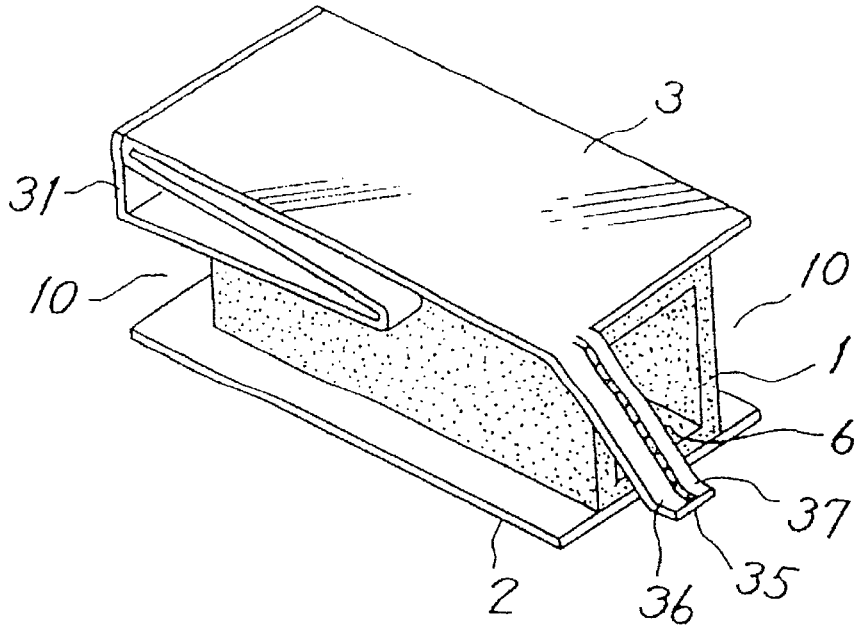
FIG. 6 is a perspective view illustrating a producing process of a sixth embodiment of the present invention.
Figure 7:
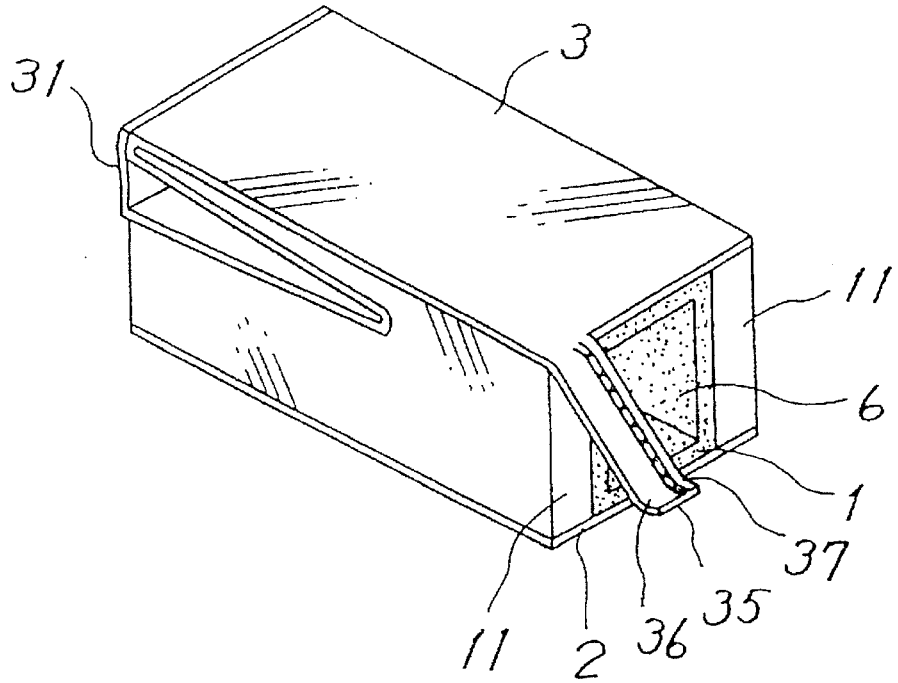
FIG. 7 is a perspective view of the sixth embodiment of the present invention.

FIGS. 6 and 7 show perspective views of the antenna module of a sixth embodiment according to the present invention in which double molding technique by extending the technique of the fifth embodiment in FIG. 5 is applied. Namely, in this sixth embodiment, as shown in FIG. 6, the antenna structure 1 is provided in the first molding process and the resin portion, i.e. the dielectric portion is not provided at the recess portion 10 at each side face of the antenna or under the peripheral portion of the antenna element conductor 3.

This structure is unstable because the peripheral portion corresponding to the recess portion 10 of the antenna element conductor 3 can not be supported. Therefore, the peripheral portion of the antenna element conductor is supported by a second resin molding 11 as shown in FIG. 7.

The dielectric or resin used in the second molding process has a dielectric constant lower than that of the resin used in the first molding process to obtain good high frequency characteristics. For example, thermoplastic Teflon, PPO (polyphenylene oxide), or PPS (polyphenylene sulfide) are most preferable.

Figure 8:
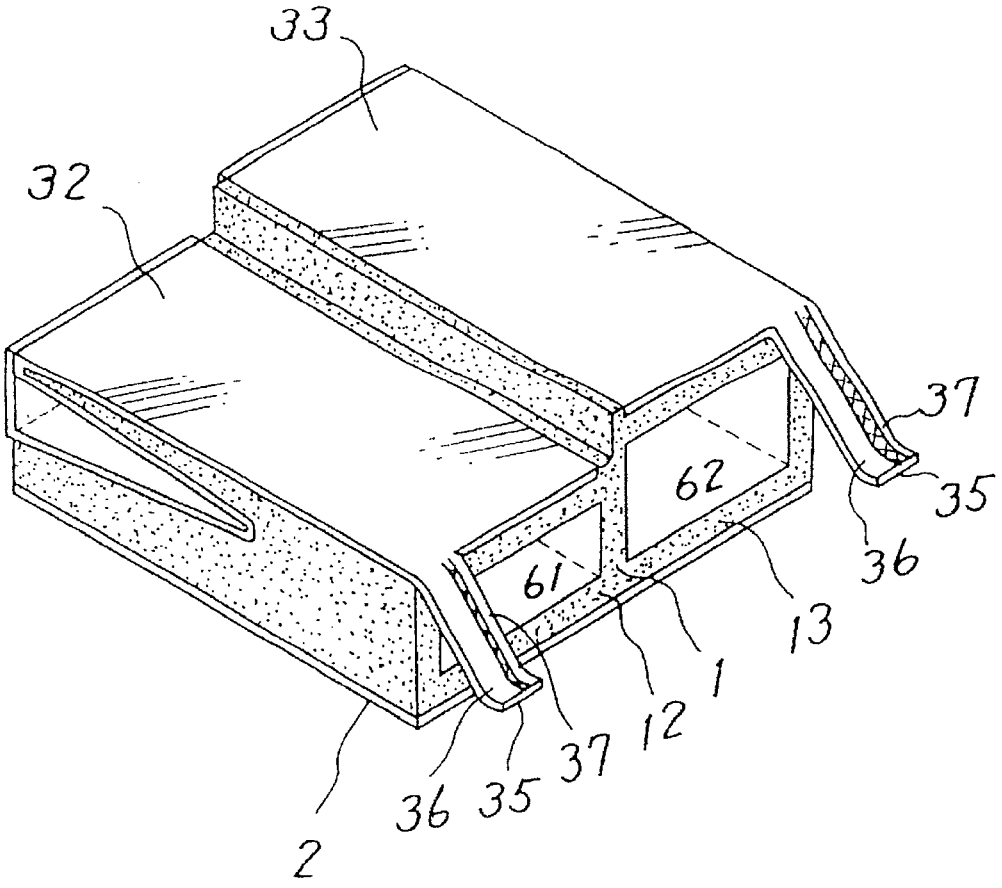
FIG. 8 is a perspective view of an embodiment including two antenna element conductors.

FIG. 8 shows a seventh embodiment according to the present invention.

This embodiment provides a composite antenna module in which two separate antenna element conductors 32 and 33 are formed on the common dielectric substrate 1.

Namely, the dielectric substrate 1 has a first dielectric block 12 and a second dielectric block 13 which are formed as a unit.

The common grounding conductor 2 is formed on the bottom face of the dielectric substrate 1 and the first antenna element conductor 32 is formed at the position corresponding to the first dielectric block 12 opposite the grounding conductor 2.

This first antenna element conductor 32 is the same as the antenna element conductor 3 in the first to sixth embodiments as above described.

The antenna element conductor 32 further has a leading portion 35 on which a grounding pin 36 and a feeder 37 are formed.

Also in the first dielectric block 12, a vacant space 61 is provided.

On the upper face of the second dielectric block 13 in the dielectric substrate 1, the second antenna element conductor 33 is formed opposite the common grounding conductor 2 like in the first dielectric block 12.

The second antenna element conductor 33 further has a leading portion 35 on which the grounding pin 36 and the feeder 37 are also formed.

The second dielectric block 13 has a vacant space 62 formed therein like in the dielectric block 12.

Figure 9:
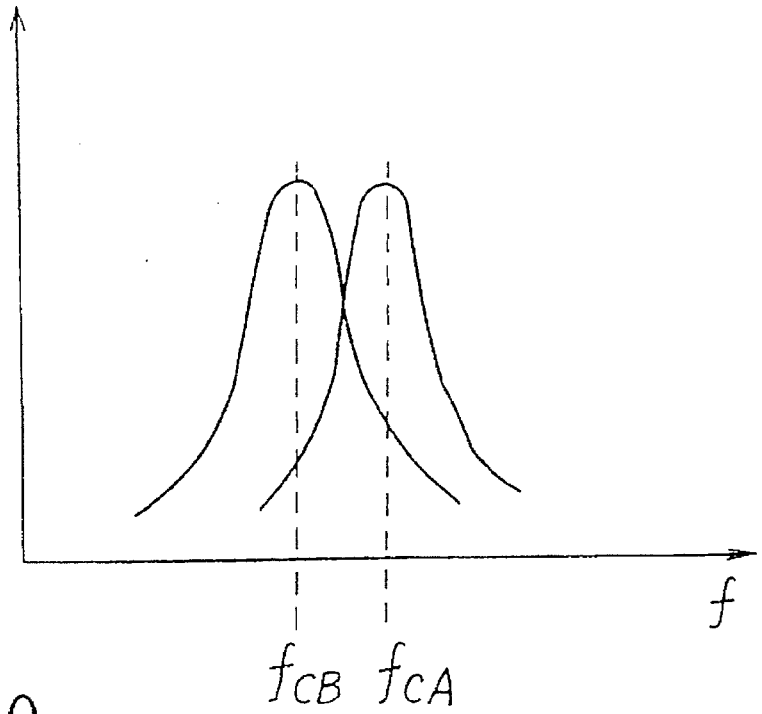
FIG. 9 is a diagram showing respective resonant frequency characteristics according to first and second antenna element modules.

FIG. 9 shows the resonance frequency characteristic of the antenna element respectively formed in the first dielectric block 12 and the second dielectric block 13. In FIG. 9, the resonance frequency characteristic with the resonance frequency $f_{CB}$ is provided by the antenna element conductor 32 in the first dielectric block 12 and the resonance frequency characteristic with the resonance frequency $f_{CA}$ is provided by the antenna element conductor 33 in the second dielectric block 13.

Depending upon how the embodiment shown in FIG. 8 is applied, for example, the antenna formed by the first dielectric block 12 may be used as an antenna element for radio transmission and the antenna formed by the second dielectric block 13 may be used as an antenna element for radio reception, both antenna elements being independent from each other.

In this case, as shown in FIG. 9, the resonance frequency of the transmitting antenna is $f_{CB}$ and the resonance frequency of the receiving antenna is $f_{CA}$.

Figure 10:
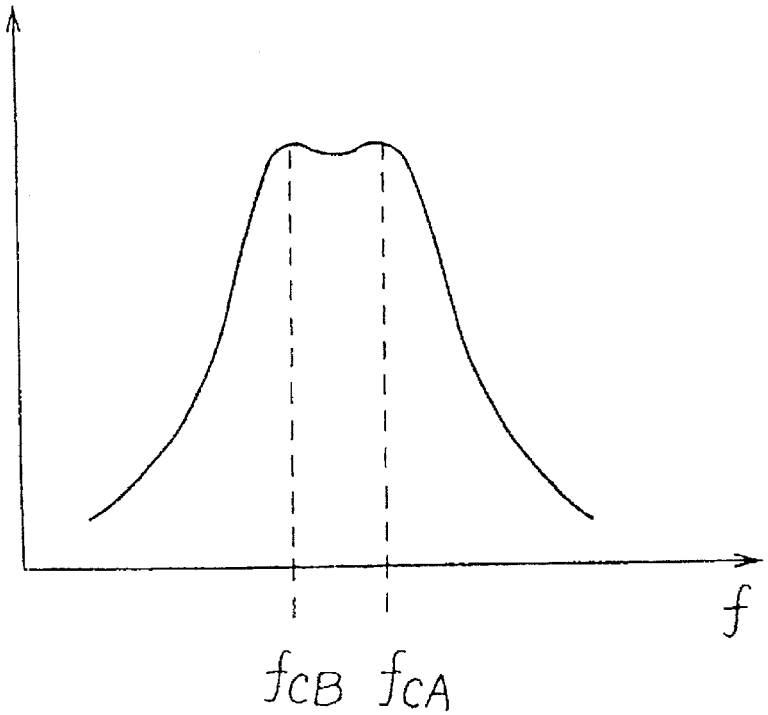
FIG. 10 is a diagram showing the resonant frequency characteristics where the first and second antenna element modules are commonly used for the realization of a broad frequency band.

FIG. 10 shows a frequency characteristic where the antenna shown in FIG. 8 is employed as a broad band which antenna.

Namely, an antenna element having a broad band width shown in FIG. 10 can be provided by commonly connecting the feeder 37 of the antenna element formed in the first dielectric block 12 and the feeder 37 of the second the antenna element formed in the second dielectric block.

There will now be studied the reason why the resonance frequencies in the first and the second dielectric blocks 12, 13 are different from $f_{CB}$ and $f_{CA}$.

Figure 11:
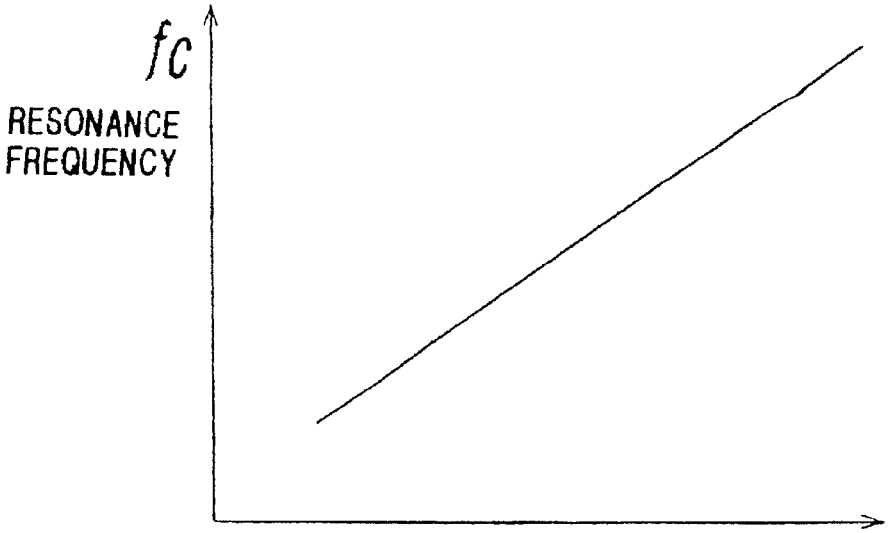
FIG. 11 is a diagram showing a relationship of a gap dimension between the antenna element conductor and a grounding conductor with a resonant frequency.

FIG. 11 is a graph showing a relationship of the dimension of the gap between the antenna element conductor and the grounding conductor with the resonance frequency $f_c$.

From this graph it is seen that as the gap between the antenna element conductor and the grounding conductor increases, the resonance frequency also increases.

In the embodiment of FIG. 8 taking advantage of this characteristic, the gap lengths of the antenna element conductors 32, 33 with respect to the common grounding conductor 2 are made different in the antenna formed in the first dielectric block 12 and the antenna formed in the second dielectric block 13.

Namely, the gap between the antenna element conductor 32 and the grounding conductor 2 in the antenna formed by the first dielectric block 12 is smaller than the gap between the antenna element conductor 33 and the grounding conductor 2 in the antenna formed by the second dielectric block 13.

It is to be noted that as the gap between the antenna element conductor and the grounding conductor decreases, the equivalent parallel capacity increases and so the reasonance frequency is reduced. It is therefore seen that the characteristic curves are obtained as shown in FIG. 9.

This fact has also been described in the paper titled "An Application of Molded Printed Circuit Board Technology to Antenna," Pre-printed Journal C-525 of the Japanese Association of Electronic, Intelligence & Communication, 1991, Spring.

Figure 12:
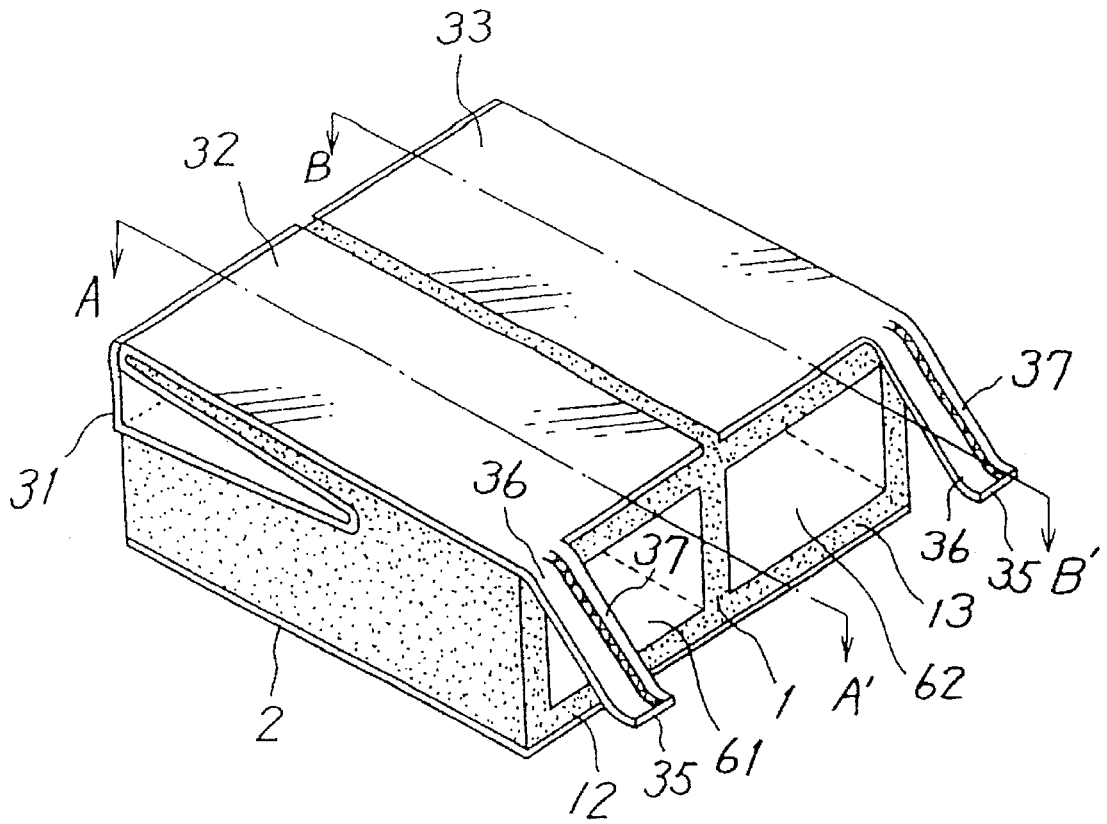
FIG. 12 is a perspective view showing another embodiment with two antenna element conductors.

FIG. 12 shows another embodiment of the antenna module having two antenna element conductors.

In FIG. 12, the common dielectric substrate 1 is divided into the first dielectric block 12 and the second dielectric block 13 in which the antenna element conductors 32, 33 are respectively formed opposite the common grounding conductor 2. It is to be noted that the antenna element conductors 32, 33 have the same structure as in the embodiment shown in FIG. 8.

Figure 13A:
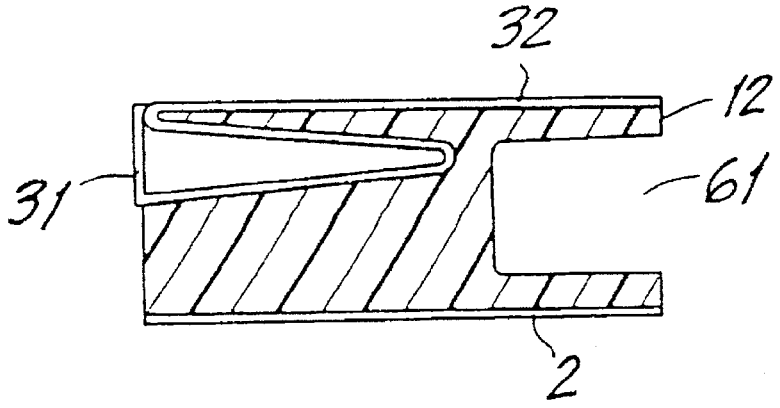
FIGS. 13A–13C show cross sectional views of the embodiment of FIG. 12.
Figure 13B:
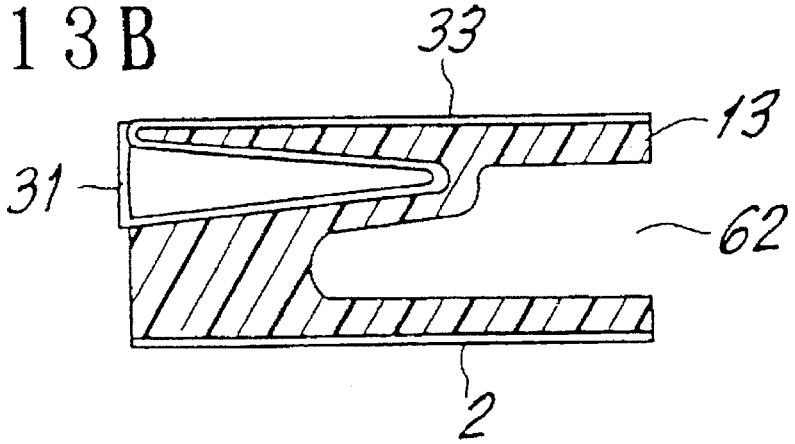
Figure 13C:
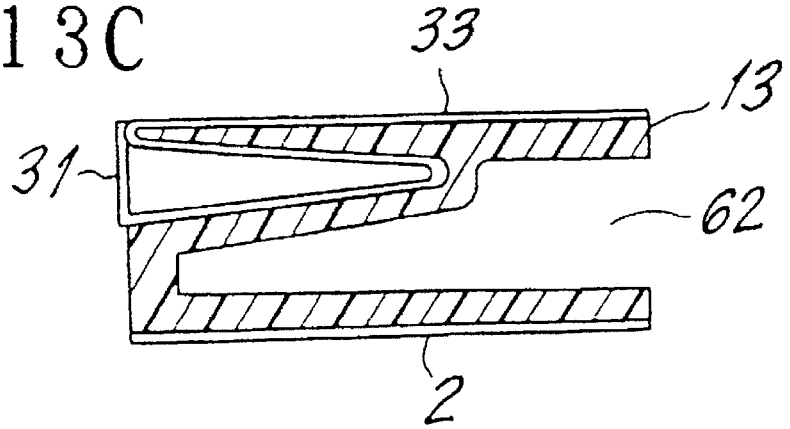

In FIG. 13, (A) shows a cross sectional view of the first antenna module formed by the first dielectric block 12 along the line A–A' in FIG. 12 and (B) in FIG. 13 shows a cross sectional view of the second antenna module formed by the second dielectric block 13 along the line B–B' in FIG. 12.

In comparison with the cross sectional view of (B) in FIG. 13, the structure of (A) in FIG. 13 has more fill of the dielectric resin between the antenna element conductor 32 and the grounding conductor 2. The applicants of this patent application have confirmed that the entire filling of the resin under the loop can reduce the resonance frequency by 10% or the like as one example.

Figure 14:
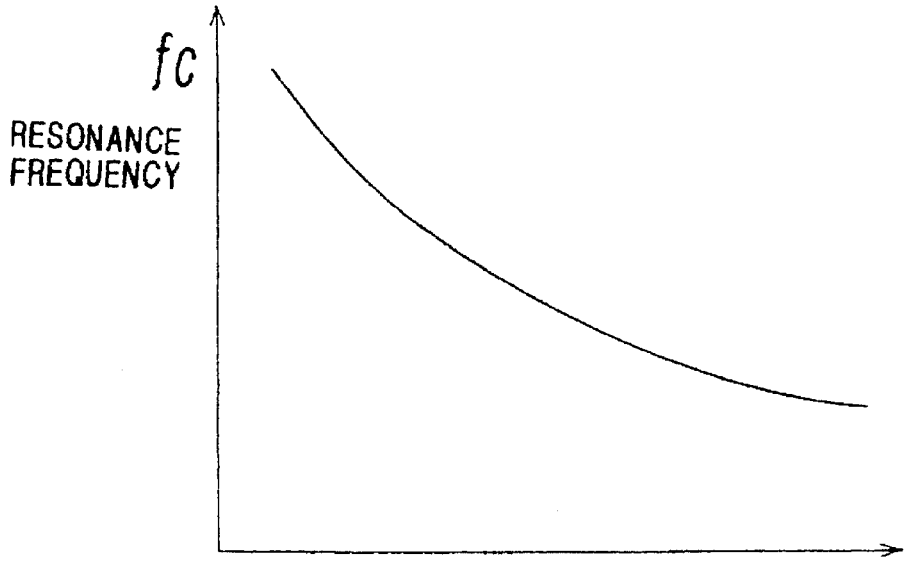
FIG. 14 is a diagram showing a relationship between the a resin fill in a looped lower portion at a leading end of the antenna element conductor and the resonant frequency.

FIG. 14 shows a graph of a relationship of the amount of resin fill between the loop lower portion at the leading end of the antenna element conductor and the grounding conductor with the resonance frequency. It is seen that the more is the amount of resin fill, the lower is the resonance frequency.

The reason for the change in the resonance frequency due to the resin fill is considered as follows:

Namely, the capacitance C between the antenna element conductor 32 and the grounding conductor 2 is given by the following equation.

$$C=\epsilon \times L/D$$

It is to be noted that $\epsilon$ represents the dielectric constant of the dielectric block, D represents the gap length between the antenna element and the grounding conductor, and L represents the size of the antenna element conductor.

The more is the amount of the dielectric fill or the resin fill, the higher is the value of $\epsilon$ so that the capacitance C is increased whereby the equivalent parallel capacitance C is increased while the resonance frequency is decreased.

Therefore, the resonance frequency $f_c$ of (A) in FIG. 13 becomes lower than that of (B) in FIG. 13.

In FIG. 13, (C) shows an example in which the gap 62 is further enlarged and the amount of resin fill between the antenna element conductor 33 and the common grounding conductor 2 is reduced. In this case, a higher resonance frequency $f_c$ is obtained.

Figure 15:
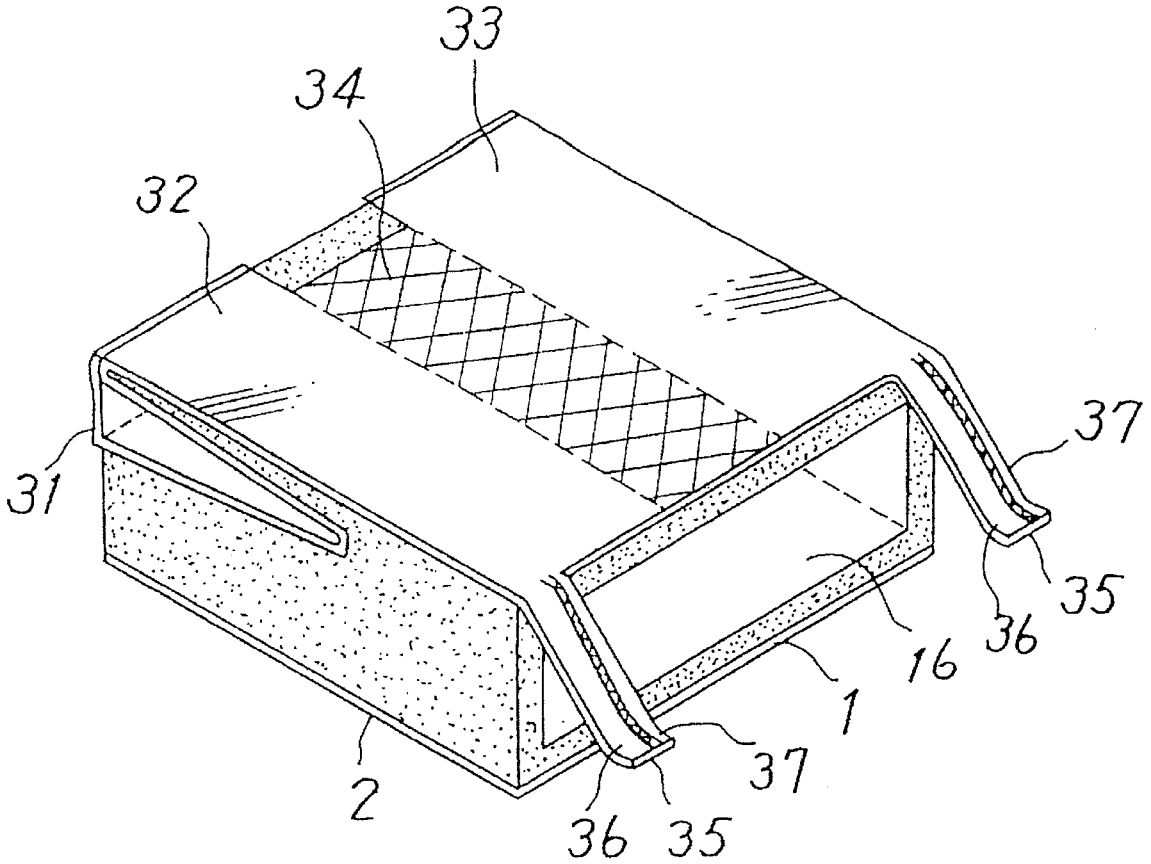
FIG. 15 is a perspective view of an embodiment for forming two antenna element conductors.

FIG. 15 shows another embodiment having two antenna element conductors.

In this embodiment, the common grounding conductor 2 is formed on the bottom face of the common dielectric substrate 1. Namely, on the bottom face of the dielectric substrate 1 the common conductor is formed opposite the grounding conductor 2. Trimming this conductor will provide the first and the second antenna element conductors 32, 33.

Namely, a conductor portion is removed at region 34 by the above trimming, the amount of which will differentiate the surface areas of the first antenna element conductor 32 and the second antenna element conductor 33.

As mentioned above, changing the dimension of the antenna element conductor 32 in the antenna module can change the resonance frequency $f_c$.

It is therefore possible that the dimensions of the first antenna element conductor 32 and the second antenna element conductor 33 can be changed by adjusting the trimmed region 34.

In this case, the space 16 can be a single common vacant space.

Figure 16:
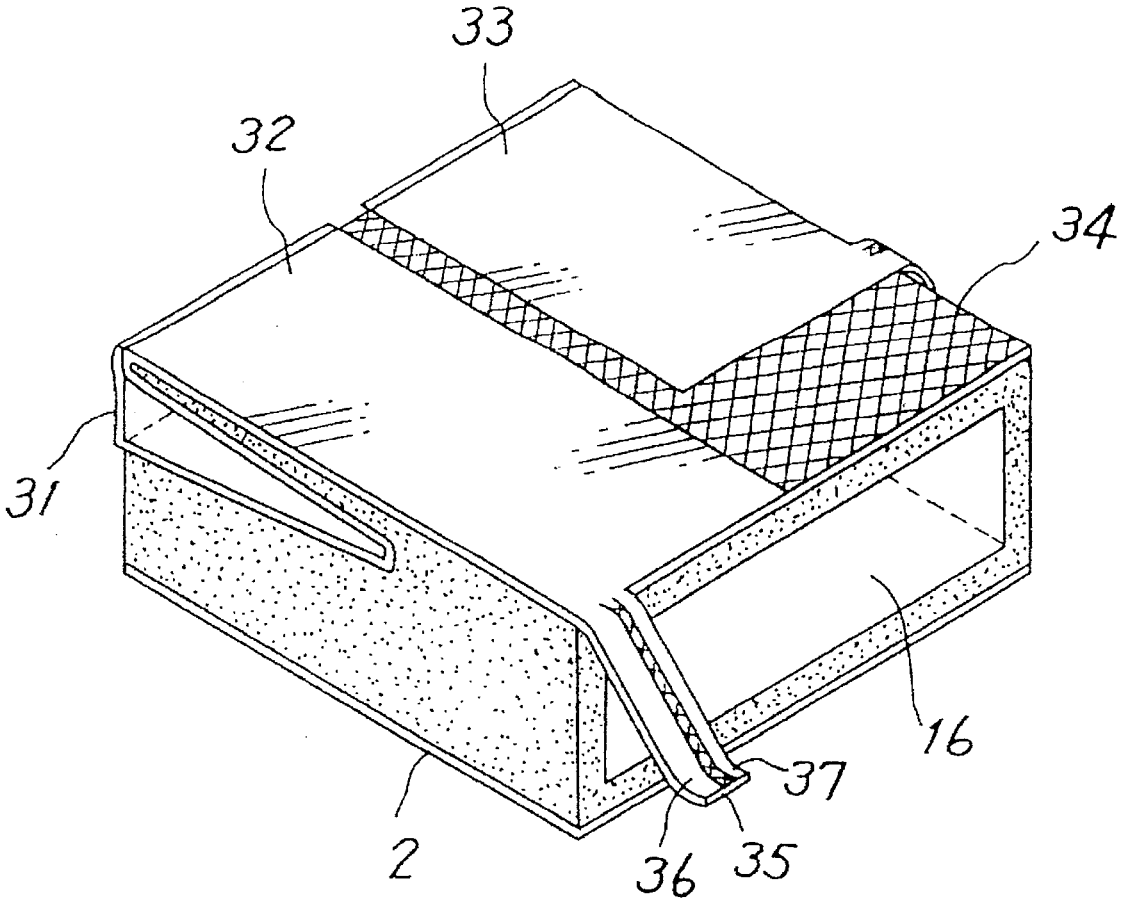
FIG. 16 is a perspective view of another embodiment for forming two antenna element conductors by trimming.

In FIG. 16 which is the modification of the embodiment in FIG. 15, the trimmed region between the antenna element conductors 32, 33 is increased so that the length of the second antenna element conductor 33 which is shortened as illustrated, can change the dimension of the first antenna element conductor 32 and the second antenna element conductor 33.

This will make the resonance frequency of the antenna element conductor 33 with a smaller dimension higher than that of the antenna element conductor 32.

Figure 17:
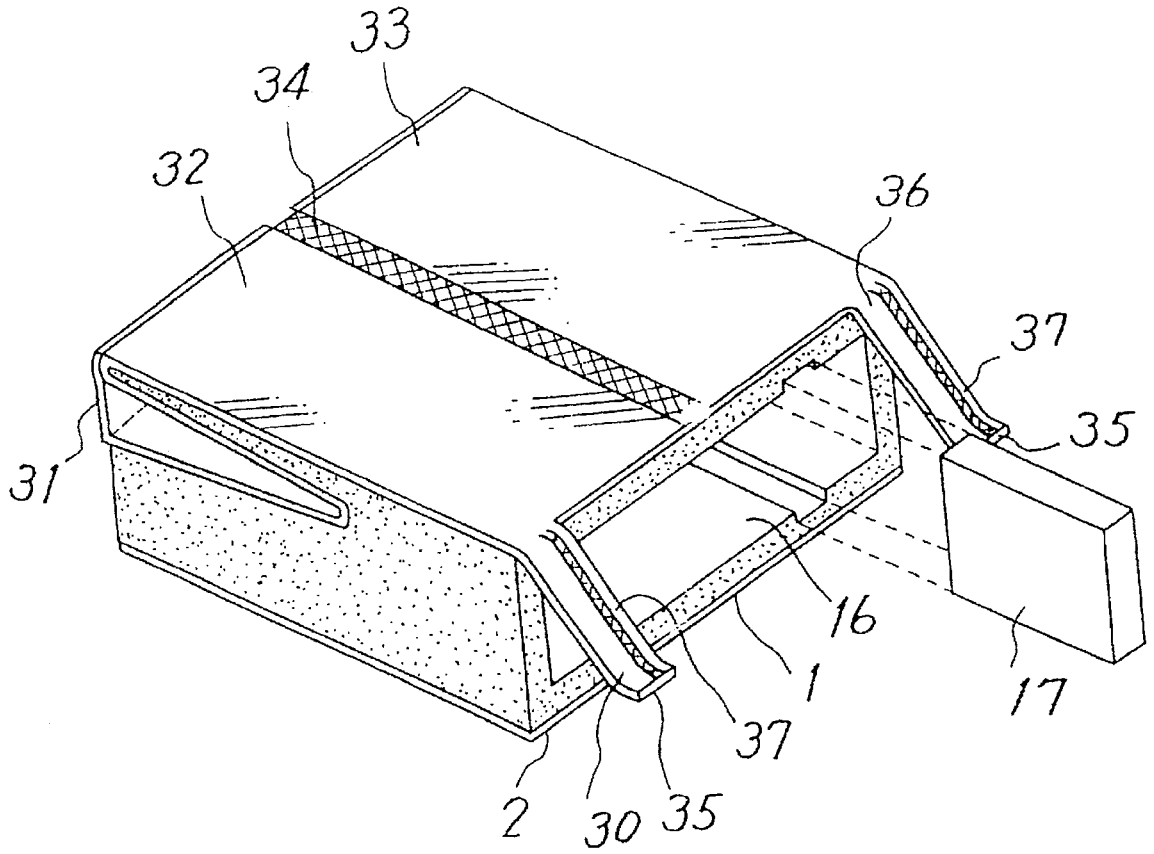
FIG. 17 is a perspective view of another structure of the antenna module with two antenna element conductors.

FIG. 17 shows an embodiment in which the structure of the embodiment of FIG. 15 is modified.

Namely, the trimmed region 34 is selected so that the dimensions of the first antenna element conductor 32 and the second antenna element conductor 33 may be the same. Furthermore, an adjusting member 17 formed of a dielectric or metal is inserted between one of the antenna element conductors and the grounding conductor 2 into space 16.

FIG. 17 shows an example of the adjusting member 17 being inserted between the second antenna element conducrtor 33 and the common grounding conductor 2 whereby the equivalent dielectric constant can be changed between the antenna element conductor 33 and the grounding conductor 2.

Accordingly, as stated above, the resonance frequency $f_c$ of the second antenna element module can be selected on the basis of the adjusting member or dielectric constant of the dielectric block 17.

It is to be noted that although adjusting member 11 is inserted from the side of the feeder terminal in the example shown in FIG. 17, the adjusting member 17 may also be inserted from the side of the leading end of the antenna element conductor 33.

It is also to be noted that while the above descriptions of the embodiments have dealt with P-type antenna, the present invention is not limited to such an antenna.

As described in the foregoing, changing the length of the antenna element conductor according to the principle of the present invention, changing the gap dimension between the antenna element conductor and the grounding conductor, and changing the amount of the resin fill between the antenna element conductor and the grounding conductor can adjust the resonance frequency.

Moreover, the provision of two antenna conductors to form a composite antenna module having different transmitting and receiving antenna elements or a common feeder for the two antenna element conductors can realize a broad frequency band.

Thus the present invention can form an antenna module having optional resonant frequencies.

The present invention may be embodied in other specific forms without departing from the spirit or essential characteristics thereof.

The present embodiment is therefore to be considered in all respects as illustrative and not restrictive, the scope of the invention being indicated by the appended claims rather than by the foregoing description and all changes, which come within the meaning and range of equivalency of the claims therefore are intended to be embraced therein.

What we claim is:

1. An antenna module comprising:

a dielectric substrate molded in a predetermined shape;

a grounding conductor in the form of a sheet provided on one surface of said dielectric substrate;

an antenna element conductor in the form of a sheet provided on an opposite surface to said one surface of said dielectric substrate and having a substantially V-shaped folded end portion; and an adjusting member inserted into said V-shaped folded end portion, wherein said adjusting member is composed of a dielectric portion and a conductor in the form of a sheet provided on a surface of said dielectric portion, and said conductor has an electrical contact with said V-shaped folded end portion and has a portion externally protruding from said end portion to effectively extend the length of said antenna element conductor.

2. An antenna module as claimed in claim 1 wherein said dielectric substrate is molded with a material of resin.

3. An antenna module as claimed in claim 1 wherein said grounding conductor and said antenna element conductor are each composed of a plastic film and a cupper leaf provided on said plastic film.

4. An antenna module comprising:

a dielectric substrate molded in a predetermined shape;

a grounding conductor in the form of a sheet provided on one surface of said dielectric substrate;

an antenna element conductor in the form of a sheet provided on an opposite surface to said one surface of said dielectric substrate and having a substantially V-shaped folded end portion; and an adjusting member inserted into said V-shaped folded end portion, wherein said adjusting member is composed of a dielectric portion and a conductor in the form of a sheet provided on at least one of the surfaces of said dielectric portions, and said conductor has an electrical contact with said V-shaped folded end portion to determine an electrical distance from said grounding conductor to said end portion.

5. An antenna module comprising:

a dielectric substrate molded in a predetermined shape having first and second portions as a unit;

a common grounding conductor in the form of a sheet provided on one surface of said first and second portions of said dielectric substrate;

a first antenna element conductor in the form of a sheet provided on an opposite surface to said one surface of said first portion of said the dielectric substrate; and a second antenna element conductor in the form of a sheet provided on an opposite surface to said one surface of said second portion of said dielectric substrate;

a resonance frequency of said the first antenna element conductor being different from that of said second antenna element conductor, wherein said dielectric substrate has a vacant space between said first antenna element conductor and said common grounding conductor and a vacant space between said second antenna element and said common grounding conductor, and further comprising a dielectric adjusting member inserted into one of said vacant spaces so that the resonance frequencies of said first and second antenna element conductors are different from each other.

6. An antenna module as claimed in claim 5 wherein said dielectric substrate is molded of a material of resin.

7. An antenna module, comprising:

a dielectric substrate molded in a predetermined shape having first and second portions as a unit;

a common grounding conductor in the form of a sheet provided on one surface of said first and second portions of said dielectric substrate;

a first antenna element conductor in the form of a sheet provided on an opposite surface to said one surface of said first portion of said the dielectric substrate; and a second antenna element conductor in the form of a sheet provided on an opposite surface to said one surface of said second portion of said dielectric substrate;

a resonance frequency of said the first antenna element conductor being different from that of said second antenna element conductor, wherein said first and second antenna element conductors have respectively looped leading ends to make the antenna module a P-type antenna.

8. An antenna module as claimed in claim 7 wherein said antenna element conductors have each a leading portion externally extending from said dielectric substrate, said leading portion being composed of a grounding wire and a feeder electrically connected to a body of a respective one of said antenna element conductors.

* * * * *